US005595348A

United States Patent [19]

Barone

[11] Patent Number: 5,595,348

[45] Date of Patent: Jan. 21, 1997

[54] MACHINE FOR TRITURATING COMPOSITE MATERIALS, PARTICULARLY FOR TRITURATING SOLID URBAN WASTE

[75] Inventor: Giuseppe Barone, Termini Imerese, Italy

[73] Assignee: ALFA S.r.L., Termini Imerese, Italy

[21] Appl. No.: 356,485

[22] Filed: Dec. 15, 1994

[30] Foreign Application Priority Data

May 18, 1994 [IT] Italy ..... PA94A0004

[51] Int. Cl.[6] ..... B02C 18/16

[52] U.S. Cl. ..... 241/36; 100/94; 100/217; 241/37; 241/224; 241/101.2; 241/243; 241/DIG. 38

[58] Field of Search ..... 241/32, 37, 224, 241/101.2, 243, 236, 36, DIG. 38; 100/94, 217, 240, 272

[56] References Cited

U.S. PATENT DOCUMENTS

| | | | |
|---|---|---|---|
| 3,682,396 | 8/1972 | Whitney et al. . | |
| 3,703,970 | 11/1972 | Benson . | |
| 3,730,043 | 5/1973 | Zimmermann . | |
| 3,845,907 | 11/1974 | Schwarz | 241/236 X |
| 3,861,117 | 1/1975 | DeFilippi . | |
| 4,411,391 | 10/1983 | Crane | 241/236 X |
| 4,565,330 | 1/1986 | Katoh . | |
| 4,566,641 | 1/1986 | Okamoto et al. | 241/236 X |
| 4,641,789 | 2/1987 | Moscardini . | |
| 4,724,662 | 2/1988 | Giandenoto et al. . | |
| 4,844,363 | 7/1989 | Garnier et al. . | |
| 4,982,907 | 1/1991 | Sedgwick et al. . | |
| 5,052,630 | 10/1991 | Hinsey et al. . | |
| 5,150,843 | 9/1992 | Miller et al. . | |
| 5,155,975 | 10/1992 | Knowler . | |
| 5,248,100 | 9/1993 | Arakawa . | |

FOREIGN PATENT DOCUMENTS

| | | |
|---|---|---|
| 2046231 | 1/1992 | Canada . |
| 2127685 | 10/1972 | France . |
| 2233470 | 1/1975 | France . |
| 2432816 | 1/1976 | Germany . |
| 2731588 | 1/1979 | Germany . |
| 8804578 | 6/1988 | WIPO . |
| 9116134 | 10/1991 | WIPO . |

*Primary Examiner*—Mark Rosenbaum
*Attorney, Agent, or Firm*—Dressler, Goldsmith, Milnamow & Katz, Ltd.

[57] ABSTRACT

The present invention relates to a machine for triturating composite materials, particularly for triturating solid urban waste, which comprises a shredding apparatus that is in turn composed of a cutting element provided with multiple blades arranged side by side along an axis, of elements for actuating the blades with a rotary motion about the axis, and of a complementary cutting element which is laterally adjacent to the cutting element. The complementary cutting element cooperates with the cutting element in shredding the material conveyed between the cutting element and the complementary cutting element, and is movable away from the cutting element to allow material that withstands the action of the blades of the cutting element to pass between the cutting element and the complementary cutting element.

28 Claims, 13 Drawing Sheets

MACHINE FOR TRITURATING COMPOSITE MATERIALS, PARTICULARLY FOR TRITURATING SOLID URBAN WASTE

BACKGROUND OF THE INVENTION

The present invention relates to a machine for triturating (shredding) composite materials, particularly for triturating solid urban waste.

It is known that one of the main problems arising in the disposal of solid urban waste is constituted by the large volume occupied by this waste with respect to its weight, with severe consequences as far as the cost of transferring it to the collection site where the waste of many users is gathered is concerned.

This problem has been partially solved by adopting compactor trucks, that is to say, trucks which are provided with devices for pressing the loaded waste and can accordingly load a larger mass of waste.

This result might be further improved if the waste were shredded before being compacted, since compaction would certainly be more effective on the shredded material.

However, adoption of shredders for this application is very limited, since solid urban waste is a highly composite mixture that can include very hard materials together with materials that would entail no problems in shredding.

The main problem in the use of conventional shredders is the need to pre-sort the materials to be shredded.

The various types of shredder that are currently commercially available are in fact sized to grind materials whose hardness lies within a preset range, above which the shredder jams or suffers even severe damage.

Accordingly, various types of shredder with various sizes and power ratings, set according to the material to be shredded, are commercially available.

If one wishes to shred a wide range of materials, it is necessary to use extremely powerful, sturdy, and bulky machines, since these machines must match the hardest material to be broken up. The problem worsens whenever the materials to be processed include exceptionally hard materials, such as for example metals, as is indeed the case of solid urban waste.

This problem has so far prevented the provision of effective shredding machines for processing solid urban waste having modest power levels and dimensions.

SUMMARY OF THE INVENTION

The aim of the present invention is to solve the above described problem by providing a machine for triturating (shredding) composite materials, particularly usable to reduce the volume of solid urban waste, that can operate even in the presence of materials which cannot be shredded owing to the power rating of the machine.

Within the scope of this aim, an object of the invention is to provide a machine which in addition to shredding can also compact the materials subjected to shredding.

Another object of the invention is to help to optimize waste collection, allowing to shred and compact it before transport and to use, for this transport, conventional transport vehicles or a smaller number of compactor trucks for an equal amount of transported material.

Another object of the present invention is to provide a low-power, compact machine suitable to replace conventional waste-containing bins without problems of aesthetic or environmental impact, indeed providing considerable improvements in view of the larger amount of material it can contain with respect to the conventional bin and in view of the containment of unpleasant odors by virtue of the separation of the stored material from the surrounding environment.

Another object of the invention is to provide a machine that can be adjusted according to the degree of hardness and shearing strength of the materials to be shredded.

Another object of the invention is to provide a machine the can also be used for the sorted collection of waste, optimizing collection and transport costs.

This aim, these objects, and others which will become apparent hereinafter are achieved by a machine for triturating composite materials, particularly for triturating solid urban waste, characterized in that it comprises a shredding apparatus that comprises a cutting element provided with multiple blades arranged side by side along an axis, means for actuating said blades with a rotary motion about said axis, and a complementary cutting element which is arranged laterally adjacent to said cutting element and cooperates with said cutting element in shredding the material conveyed between said cutting element and said complementary cutting element, said complementary cutting element being movable away from said cutting element to allow material that withstands the action of said blades to pass between said cutting element and said complementary cutting element.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
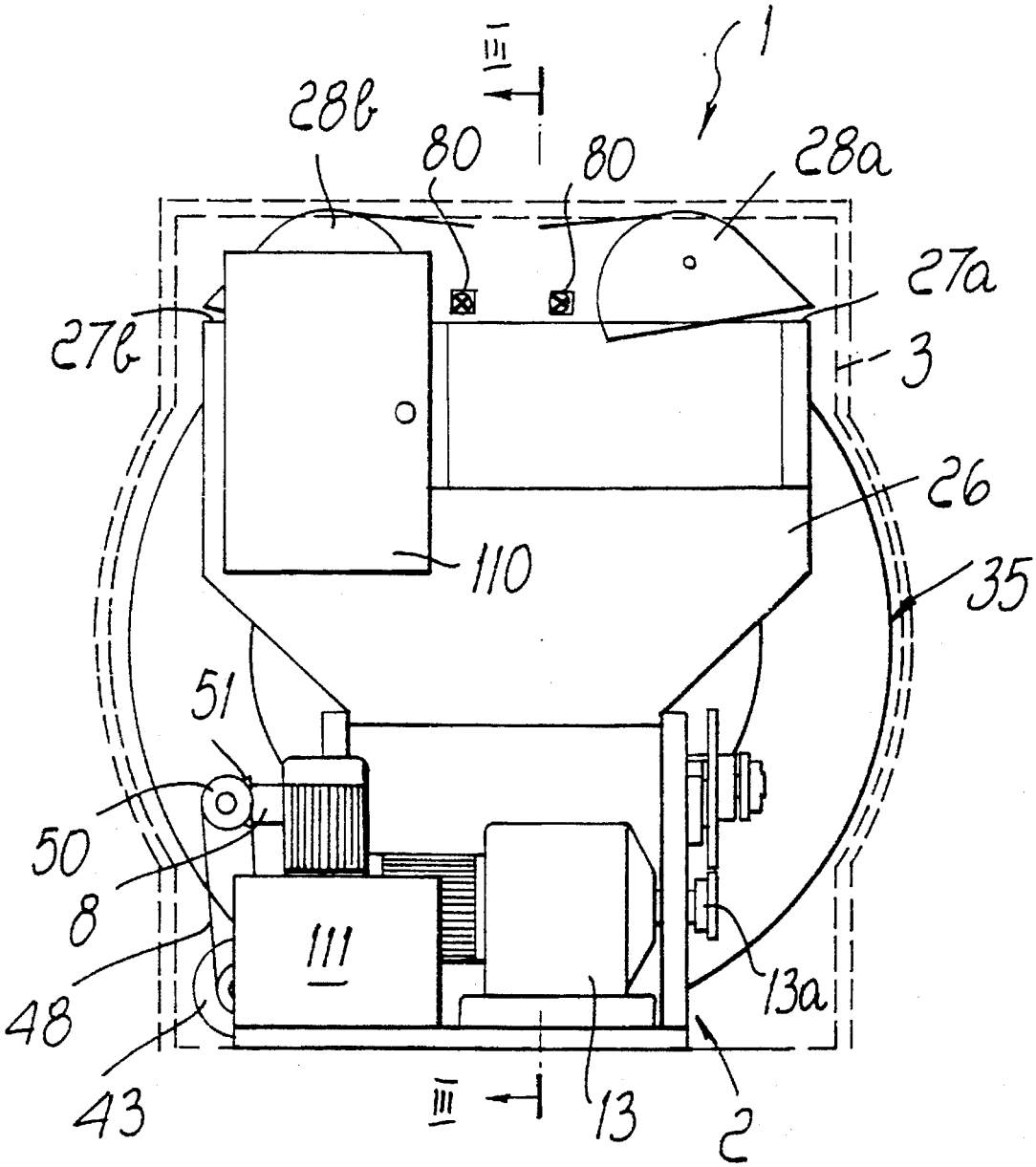
FIG. 1 is a schematic front elevation view of the machine according to the invention.
Figure 2:
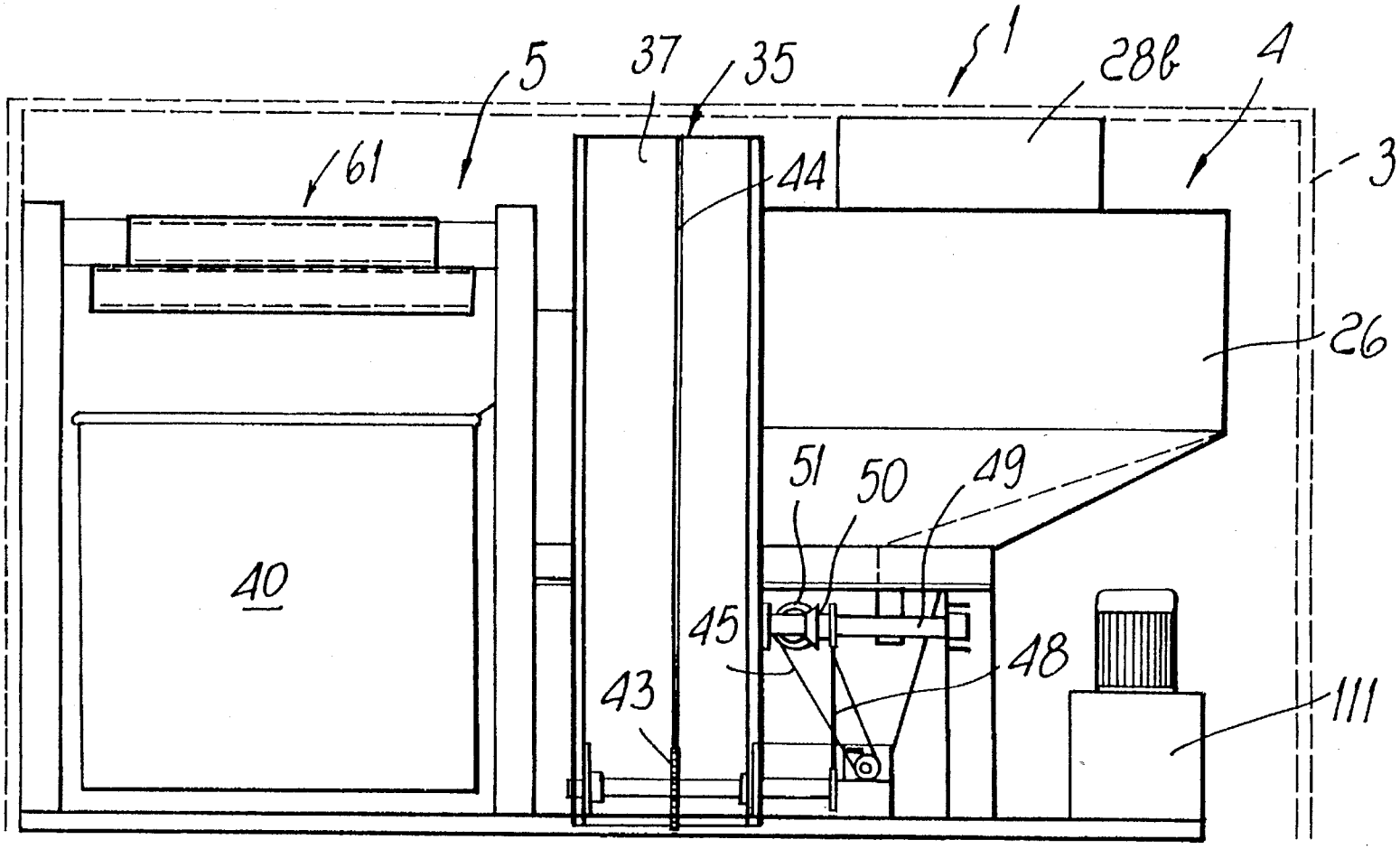
FIG. 2 is a schematic lateral elevation view of the machine according to the invention.

With reference to FIGS. 1 to 17, the machine according to the invention, generally designated by the reference numeral 1, is composed of a supporting structure 2 which is preferably contained within a box-like structure 3, shown in dashed lines in the drawings, whose dimensions are preferably comparable with those of the bins currently used for the local collection of solid urban waste.

The machine comprises a shredding apparatus 4 and preferably also comprises a compaction apparatus 5 and interposed means 6 for conveying the material that leaves the shredding apparatus to the compaction apparatus.

Figure 6:
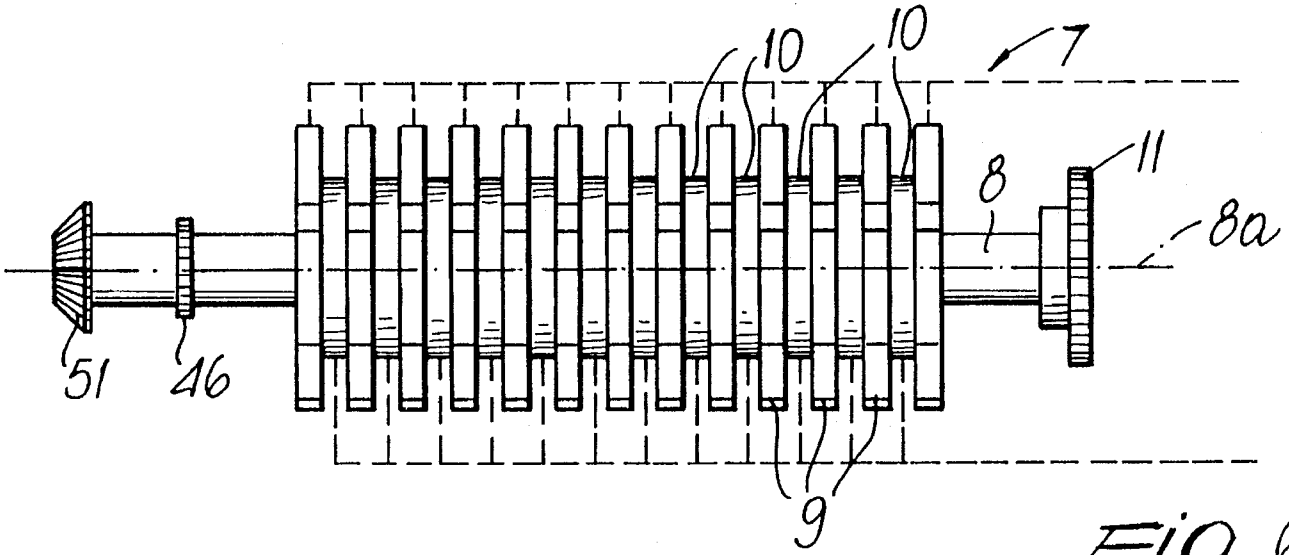
FIG. 6 is a lateral elevation view of the cutting element.
Figure 8:
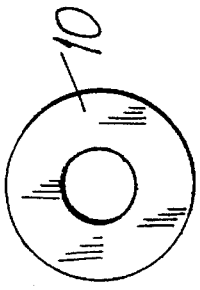
FIG. 8 is a view of one of the plates interposed between the blades of the cutting element.
Figure 7:
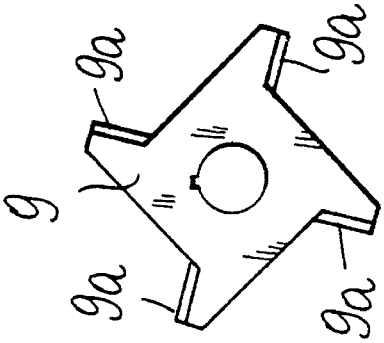
FIG. 7 is a front elevation view of a blade of the cutting element.
Figure 10:
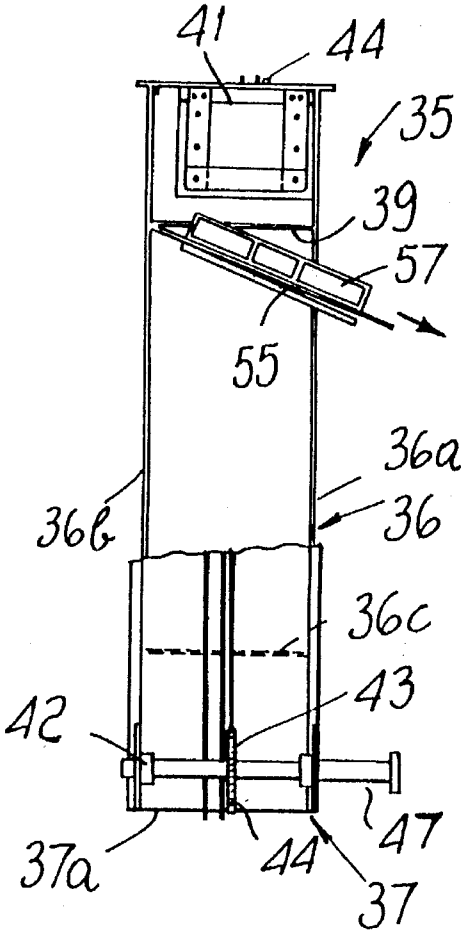
FIG. 10 is a schematic sectional view of FIG. 9, taken along the plane X—X.
Figure 9:
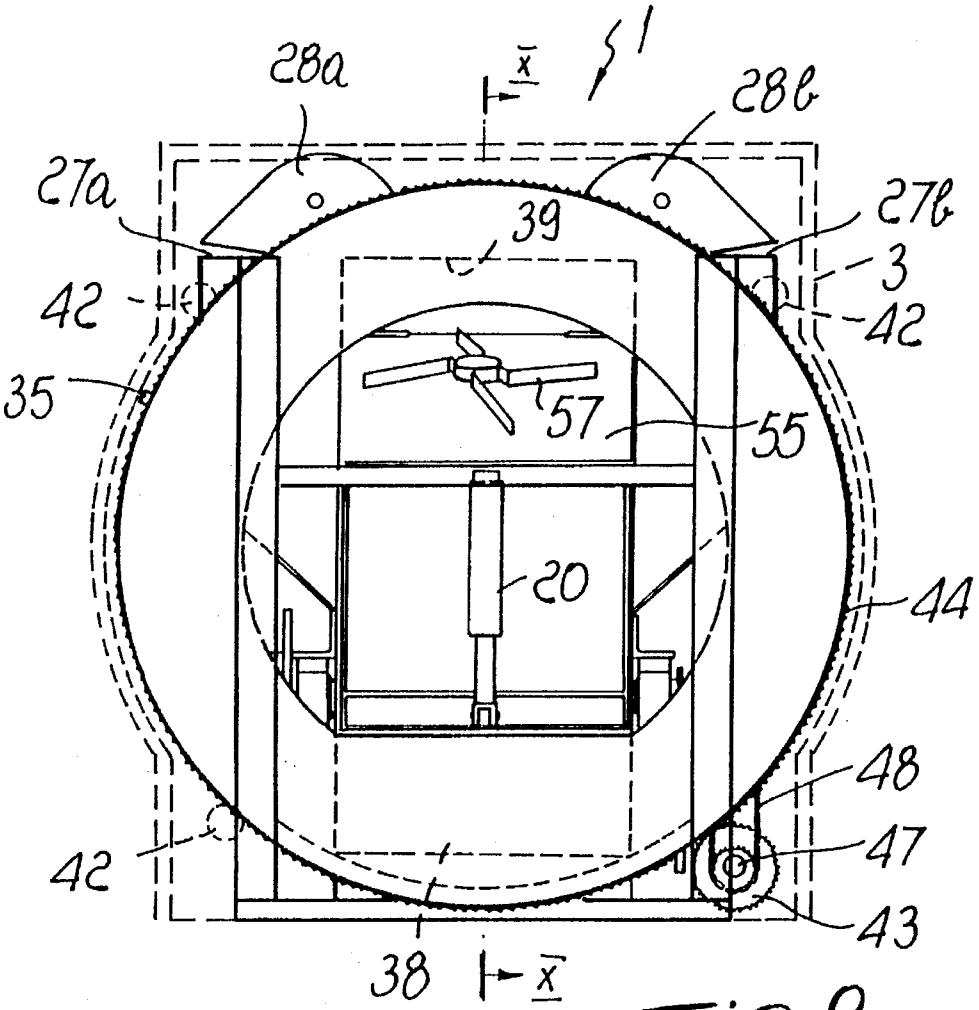
FIG. 9 is a sectional view of FIG. 3, taken along the plane IX—IX.
Figure 11:
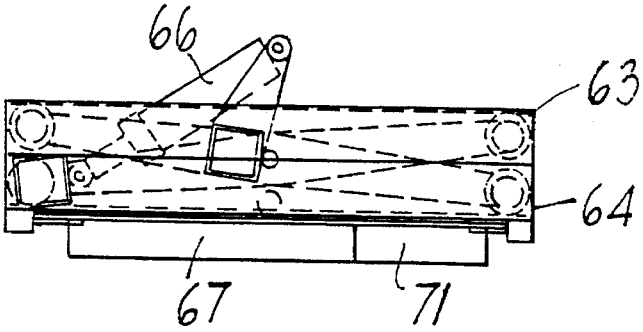
FIG. 11 is a schematic view of a detail of the machine according to the invention, related to a pantograph press in the inactive condition.
Figure 13:
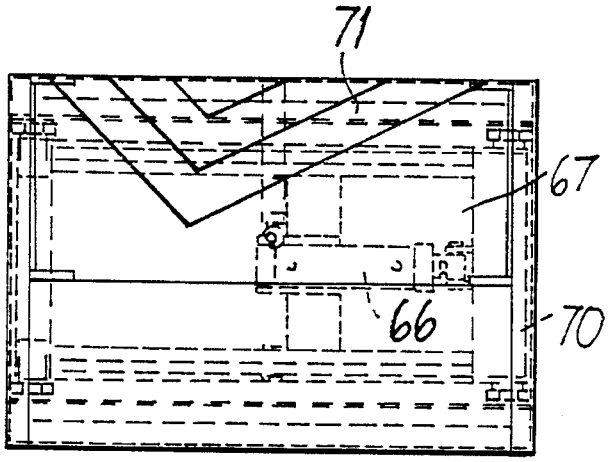
FIG. 13 is a bottom plan view of the pantograph press.
Figure 12:
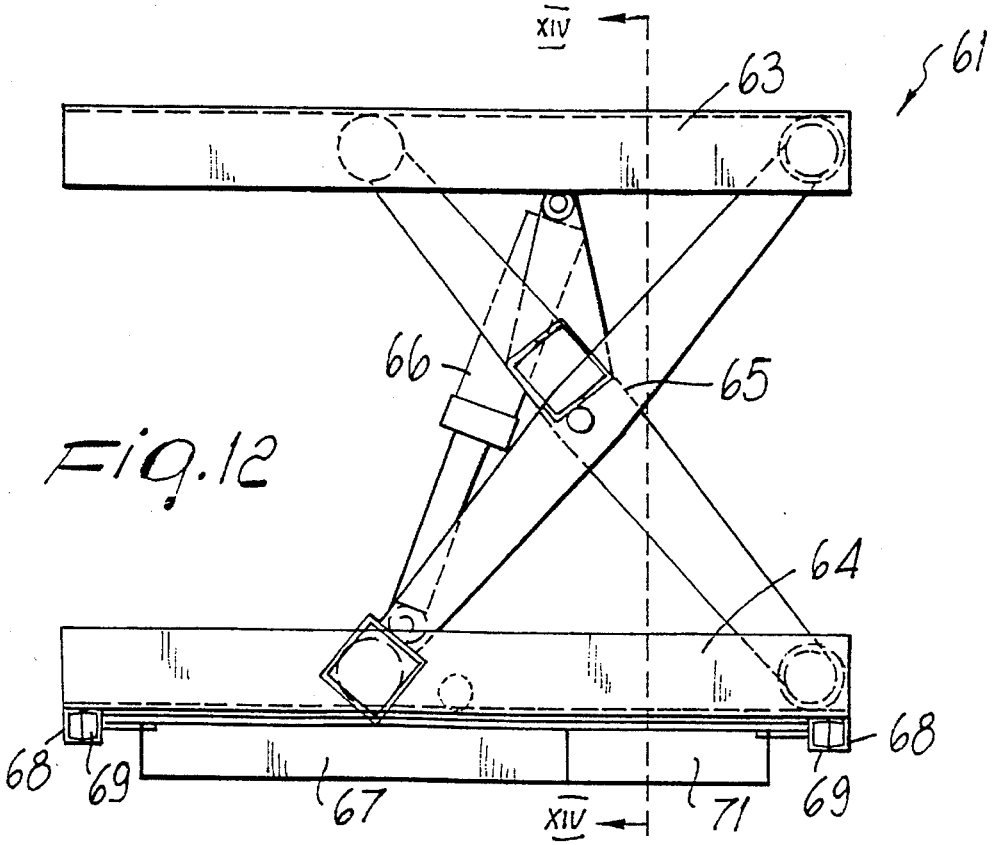
FIG. 12 is a view of the pantograph press in the active position.
Figure 15:
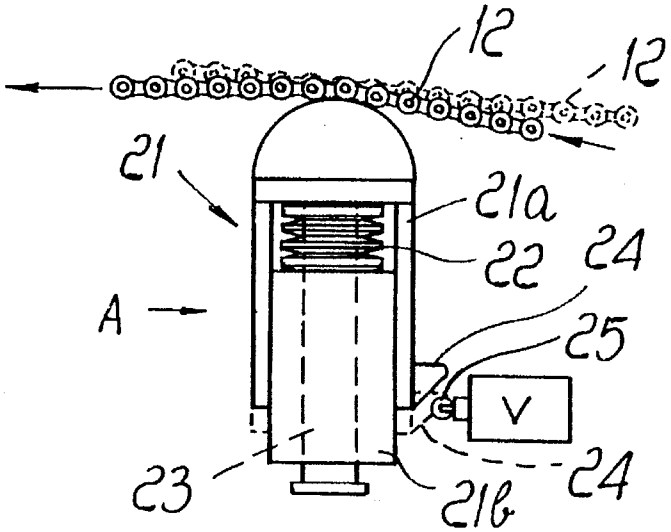
FIG. 15 is an enlarged-scale view of a detail of FIG. 3.
Figure 14:
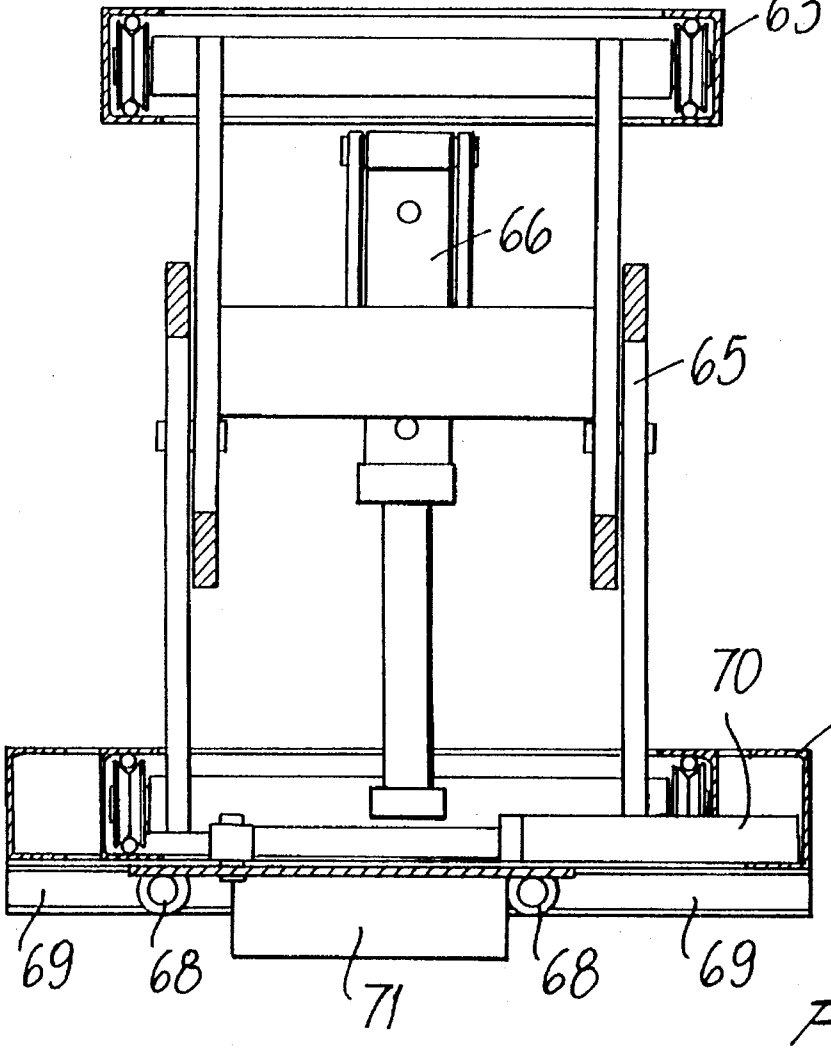
FIG. 14 is a schematic sectional view of FIG. 12, taken along the plane XIV—XIV.

More particularly, the shredding apparatus 4 comprises a cutting element 7 which is preferably constituted, as shown in particular in FIGS. 6, 7, and 8, by a shaft 8 on which multiple blades 9 are keyed; said blades have cutting edges 9*a* which are orientated in a substantially radial direction with respect to the horizontal axis 8*a* of the shaft 8.

In the embodiment illustrated in FIGS. 6 to 8, each blade has four cutting edges 9*a*, but blades with a larger or smaller number of cutting edges may also be used according to the requirements.

Spacer plates 10 are interposed between the blades 9, have a substantially disk-like shape, and are fixed coaxially to the shaft 8, that is to say, so that they rotate rigidly about the axis 8*a*.

Figure 16:
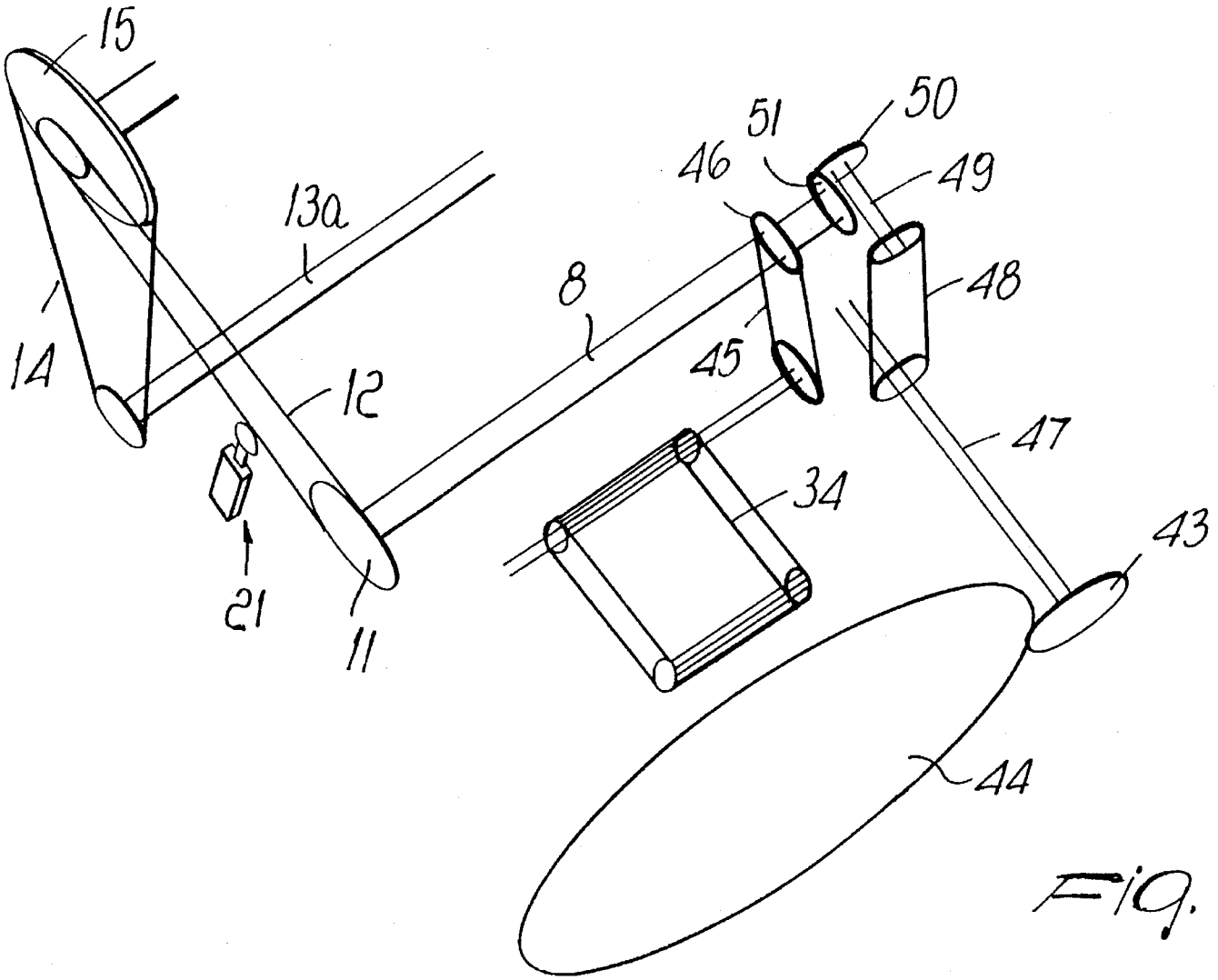
FIG. 16 is a kinematic diagram of the actuation of the machine.
Figure 17:
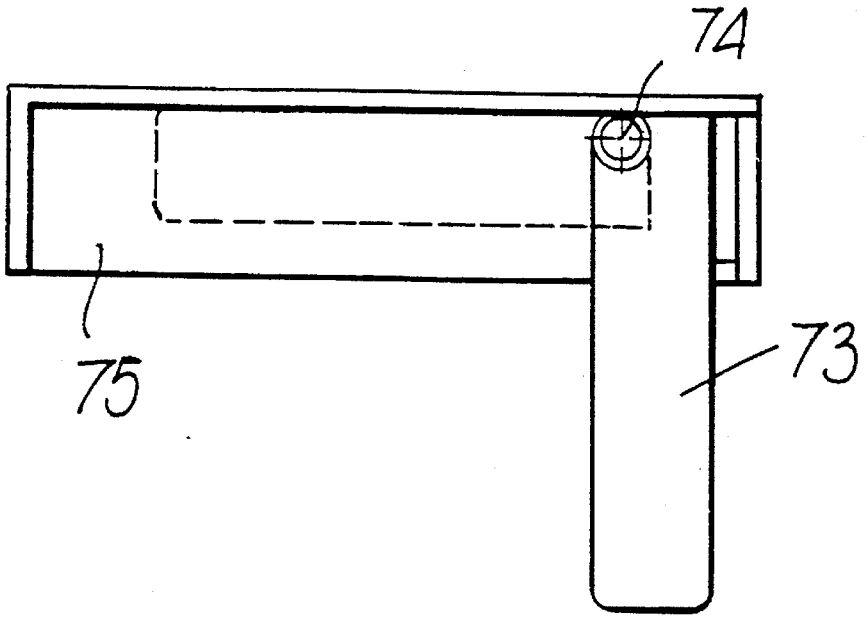
FIG. 17 is a detail view related to the container of the shredded and compacted material.

The shaft 8 has, at one of its axial ends, a sprocket 11 which is connected, by means of a chain 12, a belt, or another power transmission means, to a gearmotor 13 whose output shaft 13*a* is connected, for example by means of a chain 14, to a sprocket 15 which is in turn connected to the sprocket 11 to actuate the shaft 8, and thus the blades 9 keyed thereon, so that they rotate about their axis 8*a*, as shown in particular in FIG. 16.

The shredding apparatus 4 also comprises a complementary cutting element which is generally designated by the reference numeral 16 and comprises multiple cutters 17 which are mounted on a plate 18 that lies substantially parallel to the axis 8*a* of the shaft 8. The cutters 17 are mutually spaced so as to match the spacing of the blades 9 on the shaft 8, so that they can be inserted, by moving the plate 18, between the blades 9 supported by the shaft 8 and can thus cooperate with said blades in shredding the material that is conveyed between the cutting element 7 and the complementary cutting element 16.

The complementary cutting element 16 is movable away from the cutting element 7 to allow any material that withstands the action of the blades 9, and therefore cannot be shredded, to pass between the cutting element 7 and the complementary cutting element 16.

More particularly, the plate 18 is supported by the supporting structure of the machine so that it can oscillate about an axis 19 which is substantially parallel to the axis 8*a* of the shaft 8, and there is a hydraulic cylinder 20 whose body is fixed to the supporting structure of the machine; the end of the stem 20*a* of the cylinder piston acts against the plate 18 so as to cause its oscillation about the axis 19 and move the cutters 17 towards or away from the cutting element 7.

The shredding apparatus 4 conveniently comprises means for sensing the presence of non-shreddable material between the cutting element 7 and the complementary cutting element 16. Said sensing means, as shown in particular in FIG. 15, comprise a sensor 21 composed of two parts, respectively 21*a* and 21*b*, which are mutually assembled in a telescopic manner, with the interposition of a spring 22 that acts by compression. The pre-loading of the spring 22 can be changed by varying the mutual distance between the portions 21*a* and 21*b*, for example by means of a threaded shaft 23 that mutually connects the parts 21*a* and 21*b*.

One end of the part 21*a* is shaped so that it can rest against the active portion of the chain 12 that connects the shaft 8 to the gearmotor 13. The part 21*a* is furthermore provided with a tooth 24 that is suitable to make contact with a switch 25 when the part 21*a* moves with respect to the part 21*b* so as to compress the spring 22.

Above the shredding apparatus composed of the cutting element 7 and of the complementary cutting element 16 there is a hopper 26 that has two loading inlets 27*a* and 27*b* closed by corresponding lids 28*a* and 28*b* that can be opened by control to allow to load the material to be shredded, for example by means of a known pedal-operated control which is not illustrated for the sake of simplicity.

The extent to which the lids 28*a* and 28*b* open can be studied so as to allow only one waste bag at a time, and thus a preset maximum amount of waste, to pass.

Proximate to the bottom of the hopper 26, that is to say, proximate to its outlet directed towards the region where the cutting element 7 is located, there is a flap 29 for adjusting the flow of loaded material towards the cutting element 7. Said flap 29 is hinged, at one of its sides, to the supporting structure of the machine about an axis 30 and allows the loaded material to pass from the hopper 26 to the cutting element 7. When the cutting element 7 is operating, by rotating the flap 29 it is possible to allow the material to undergo further shredding if it has not been shredded. The downward swing of the flap 29 is limited by the abutment 31.

Figure 3:
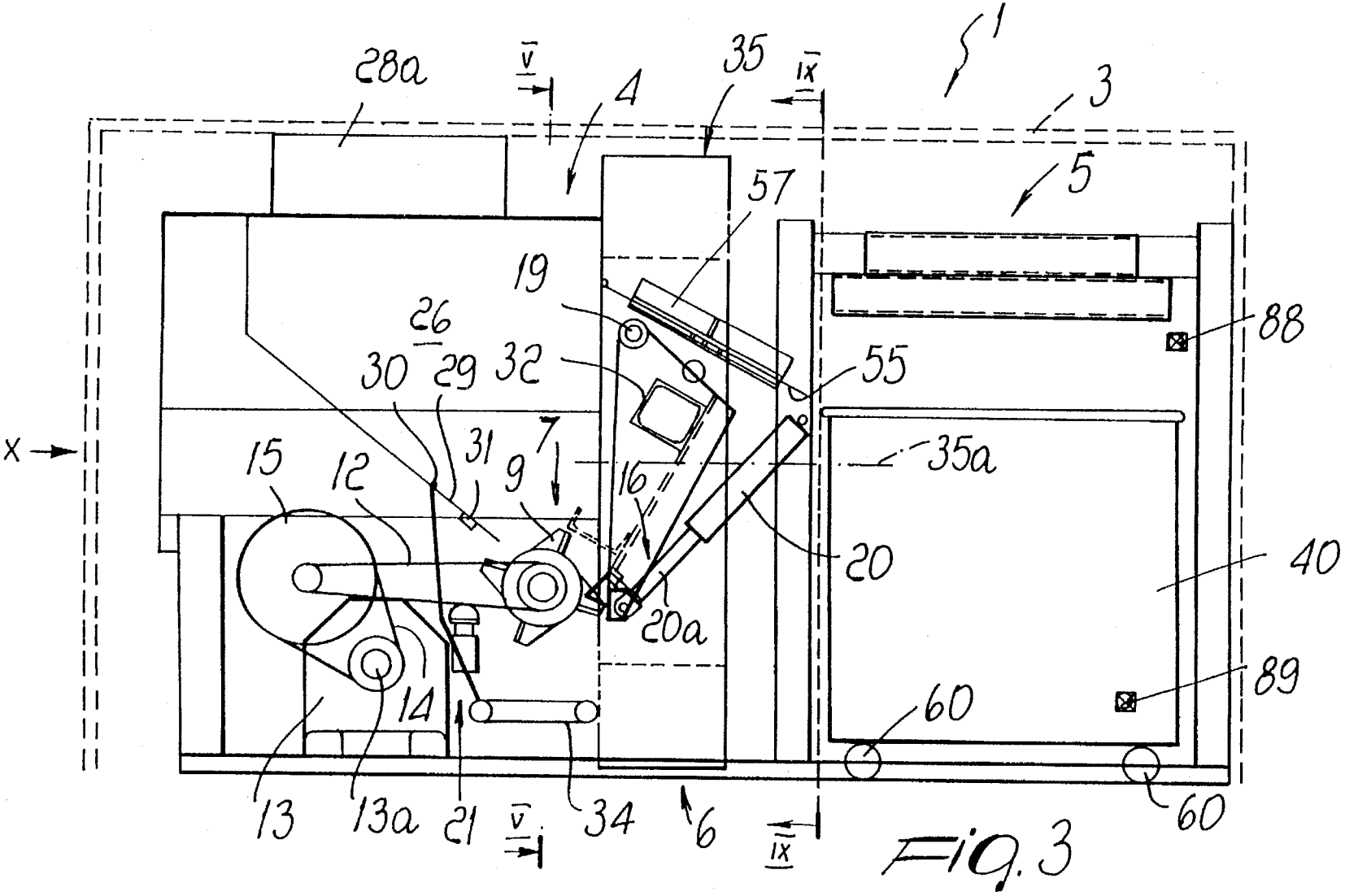
FIG. 3 is a schematic sectional view of FIG. 1, taken along the plane III—III, with the shredding apparatus in normal operating conditions.
Figure 4:
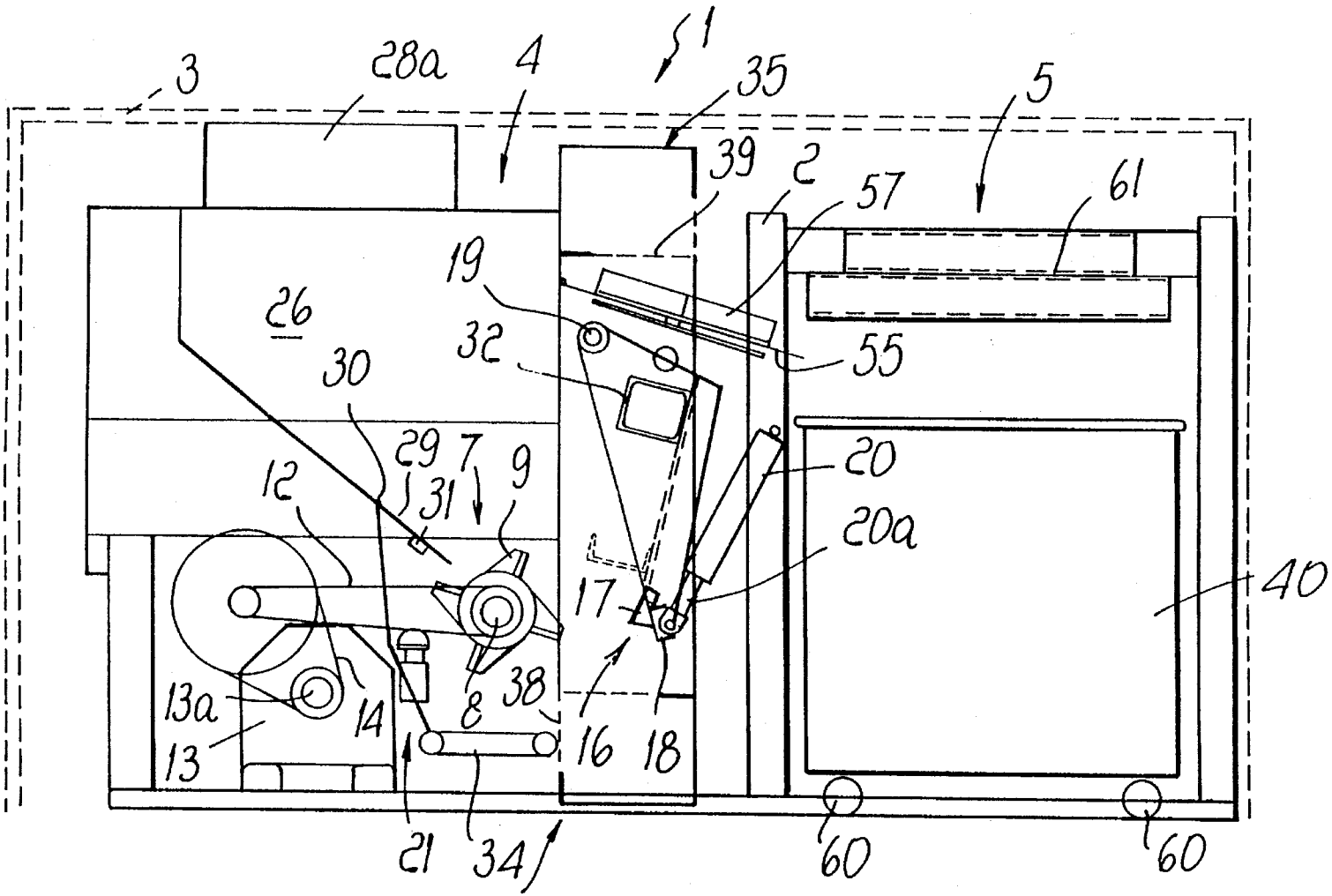
FIG. 4 is a schematic sectional view, taken similarly to FIG. 3, with the shredding apparatus in the operating mode used for the passage of material that cannot be shredded.
Figure 5:
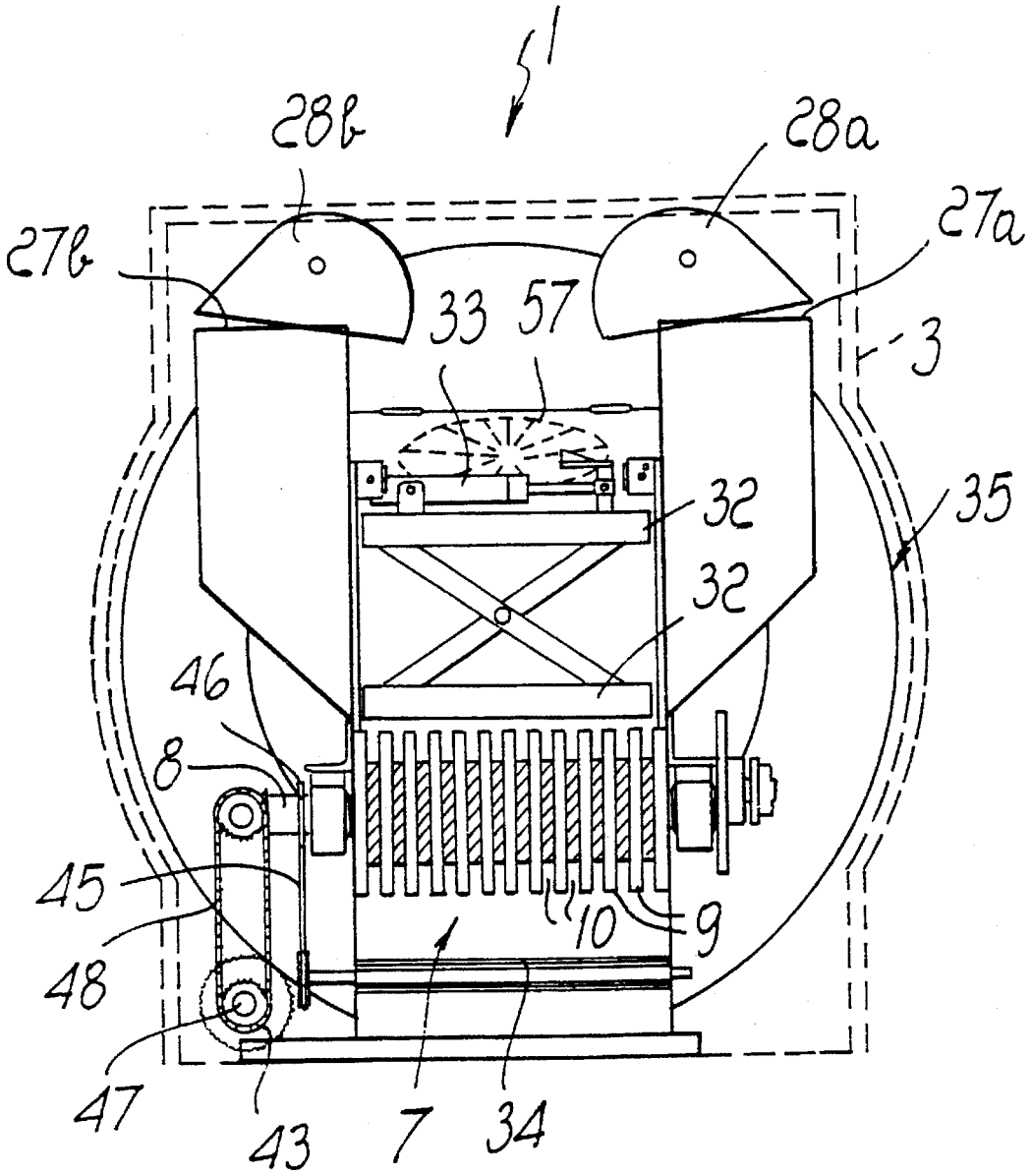
FIG. 5 is a schematic sectional view of FIG. 3, taken along the plane V—V.

Above the region that lies between the cutting element 7 and the complementary cutting element 16 there are also means for pressing the material conveyed to said region. Said pressing means are conveniently constituted by a pantograph press 32 which is actuated for example by a hydraulic cylinder 33. As seen in FIGS. 3–4, the press 32 is mounted on the oscillating plate 18 such that the press 32 assumes a position relative to the cutting element 7 dependent upon the position of the oscillating plate 18 relative to the cutting element 7.

The means 6 for conveying the material that leaves the shredding apparatus 4 comprise a substantially horizontal conveyor belt 34 which is arranged below the shredding apparatus 4 and conveys the material that leaves the shredding apparatus 4 to a conveyor 35 that lies in a ring-like manner around a substantially horizontal axis 35*a* which is arranged transversely to the axis 8*a* of the shaft of the cutting element 7.

The ring conveyor 35 is shaped like a circular channel or the like and is constituted by a fixed structure 36 and by a rotating structure 37.

The fixed structure 36 is constituted by a ring 36*c* made of sheet metal or other suitable material which is enclosed by two walls 36*a* and 36*b* made of the same material, so as to form an annular channel which is open towards the outside. One of the two walls 36*a* and 36*b* is provided with the material loading inlet 38 at the bottom and the other wall has the material discharge outlet 39 at the top.

The ring conveyor 35 allows to convey the shredded material upwardly from below so that it can be deposited in a bin-like container 40 which is located below the compaction apparatus 5, as will become apparent hereinafter.

The rotating structure 37, which performs the actual conveyance, is constituted by another ring 37*a* made of sheet metal or other suitable material which lies concentrically to the ring 36*c* of the fixed structure and has a greater radius than said ring; said ring 37*a* is superimposed on the ring 36*c* and forms a closed channel in which the materials are conveyed by flexible paddles 41 which are preferably made of steel and rubber plates or of other materials and anchored to the ring 37*a*.

The paddles 41 are slightly smaller than the cross-section of the channel in which they move, and are spaced with respect to the wall of the loading inlet 38 so as to allow even larger materials, such as unshredded materials, to enter the conveyance channel without risking jamming.

The two opposite walls 36*a* and 36*b* of the fixed structure 36 support conveyor bearings 42 which in turn support, from the outside, the rotating structure 37 and a transmission ring gear 43 which meshes with a chain 44 which is fixed coaxially on the outer skirt of the rotating structure 37.

As shown in particular in FIG. 16, the horizontal conveyor belt 34 is driven by means of a chain or belt 45 which is connected to a sprocket or pulley 46 keyed to the shaft 8, whereas the transmission ring gear 43 is keyed to a shaft 47 which is connected, in its rotation about its axis, by means of a belt or chain 48, to another transmission shaft 49 on which a bevel gear 50 is keyed; said bevel gear meshes with a bevel gear 51 which is keyed on the shaft 8.

An inclined plane 55 is provided below the discharge outlet 39 and slopes downwardly towards the underlying container 40. An expulsion device 57 is arranged on said inclined plane 55 and is substantially constituted by a propeller-like fixture that rests on the inclined plane 55 and is rotatable about its own axis, which lies substantially at right angles to the plane 55, by virtue of the action of the same hydraulic cylinder 33 that actuates the pantograph press 32 of the means for pressing the material inside the shredding apparatus 4. The propeller-like fixture of the expulsion device 57 and the hydraulic cylinder 33 can be connected by means of a transmission device that converts the reciprocating straight-line motion of the stem of the piston of the cylinder 33 into a rotary motion of the propeller-like fixture of the device 57.

The compaction apparatus 5 comprises a container 40 which is conveniently provided, in a downward region, with wheels 60 to facilitate its movement. Said container 40 is meant to be accommodated inside the box-like structure 3 to receive the shredded material and be removed from the box-like structure 3 so as to allow to remove the shredded and compacted material. The compaction apparatus comprises a press, preferably a pantograph press 61, which is arranged above the container 40 located inside the box-like structure 3. As shown in particular in FIGS. 11 to 14, said pantograph press 61 comprises an upper plate 63 which is fixed to the supporting structure of the machine and a lower plate 64 which is connected to the upper plate 63 by means of a scissor-like device 65 in which two ends are respectively pivoted to the upper plate 63 and to the lower plate 64 and two other ends can slide freely along said plates to allow them to move mutually apart or closer under the control of a hydraulic cylinder 66. The spacing of the lower plate 64 from the upper plate 63 by virtue of the actuation of the hydraulic cylinder 66 presses the materials conveyed inside the underlying container 40.

Means for levelling the material in the container 40 are provided on the lower face of the lower plate 64 of the pantograph press 61.

Said levelling means comprise a carriage 67 which is provided with wheels 68 that can run within guides 69 provided for this purpose on the lower face of the plate 64 of the pantograph press. The carriage 67 is in the inactive position when the press 61 is raised above the container 40. When the press is in the active position, the carriage 67 is moved under the thrust of a hydraulic cylinder 70 which is associated with the lower surface 64 of the press and acts on the carriage 67 with the stem of its piston. The movement of the carriage 67 levels the inside of the container 40 by means of the levelling flaps 71 that are applied to said carriage.

The container 40 has lateral hooks 73 which are pivoted to the body of the container 40 and can be accommodated, by rotating the hook, about its pivoting axis 74, inside appropriate seats 75 provided on the lateral surface of the container 40, so that once they have been moved outside said seats 75 they can be picked up by the lifting units of conventional trucks to unload the materials into said trucks.

The machine according to the invention is completed by a hydraulic control unit 111 which, by means of a system of pipes, supplies the cylinder 66, the cylinder 70, the cylinder 20, and the cylinder 33, and by an electronic control unit, shown schematically in FIG. 1 and designated by the reference numeral 110, which controls and actuates the operation of the various parts of the machine.

The operation of the machine according to the invention is as follows.

Once a bag of waste has been inserted in the loading inlets of the hopper 26, a sensor 80 located at said loading inlet 27*a* or 27*b* is activated and starts the gearmotor 13 and the hydraulic control unit. The material introduced in the machine reaches the shredding apparatus 4 which, since the shaft 8 is actuated so as to rotate about its own axis 8*a*, acts on the introduced material with the blades 9, in cooperation with the cutters 17 of the complementary cutting element 16, shredding said material and making it pass on the horizontal conveyor belt 34.

If the introduced material includes material that in practice cannot be shredded, said material blocks the shaft 8 when it is located between the blades 9 of the cutting element 7 and the cutters 17 of the complementary cutting element 16. Due to this blocking or braking action, the active portion of the chain 12 is subjected to a stretching action that switches the position of the sensor element 21, thus signalling the presence of non-shreddable material. As a consequence of this signal, the operation of the gearmotor 13 is interrupted and so is the rotation of the shaft 8 about its own axis. The halting of the gearmotor 13 reduces the tension of the active portion of the chain 12 and thus again switches the position of the sensor 21, which provides a clearance signal for restarting the gearmotor. When the gearmotor 13 is stopped, the hydraulic control unit is also stopped and connects the hydraulic cylinder 20 to the discharge. When the gearmotor 13 is restarted, the hydraulic control unit 111 is activated with a certain delay, so that the hydraulic cylinder 20 remains connected to the discharge, whereas the cutting element 7 starts to rotate so that the non-shreddable material can pass between the cutting element 7 and the complementary cutting element 16 which, since the hydraulic cylinder 20 is connected to the discharge, can move away from the cutting element 7 by virtue of the rotation of the cutting element 17.

The subsequent feeding of the hydraulic cylinder 20 restores the conditions for the correct shredding of the materials until more non-shreddable material is inserted. Accordingly, in the presence of material whose shearing strength is lower than the value preset in the materials identification system, which is substantially constituted by the setting of the sensor 21, the shredding apparatus 4 allows the complementary cutting element 16 to remain in the correct position closer to the cutting element 7, cooperating with the cutting element 7 in shredding the material. When material whose shearing strength is higher than the strength preset by setting the spring of the sensor 21 wedges between the cutting element 7 and the complementary cutting element 16, the complementary cutting element 16 moves away from the cutting element 7 to allow the non-shreddable material to pass freely.

The machine is completed by additional sensors 88 and 89 which are connected to the electronic control unit 110 and located proximate to the compaction apparatus 5 to detect the position of the pantograph press 61 and the presence of the container 40.

The electronic control unit can be programmed so as to stop the operation of the machine after a preset number of operating cycles or after a preset time. The compaction apparatus is activated after a preset number of activations of the shredding apparatus, and the shredding functions are disabled during compaction. The compaction apparatus is provided with a pressure-controlled switch or with another suitable system that returns the press 61 to the inactive position when a preset pressure is reached; after this, the shredding apparatus is activated again. When the container 40 is full, the sensor 88 disables all the functions of the machine until the container 40 is emptied and correctly placed again inside the machine.

FIGS. 18 to 21 illustrate some of the possible further embodiments of the cutting element and of the shredding apparatus.

Figure 18:
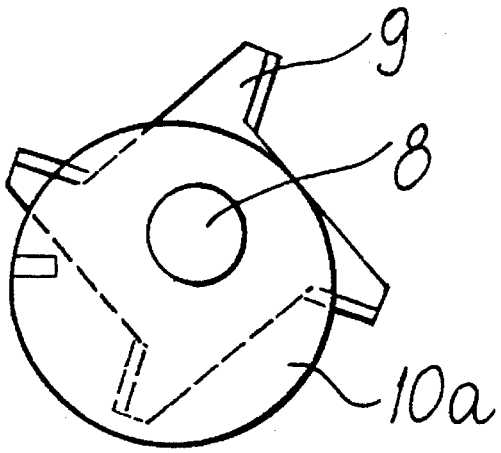
FIG. 18 is a transverse sectional view of a further embodiment of the cutting element.

As shown in particular in FIG. 18, the cutting element 7*a* can have, between the various blades 9, multiple substantially disk-like plates 10*a* which are interlaid between the blades 9 and are arranged eccentrically on the shaft 8. The plates 10*a* are mounted freely on the shaft 8 and are fixed to the supporting structure of the machine. The particular arrangement of the plates 10*a* with respect to the blades 9 cleans the blades during the rotation of the blades 9 about the axis 8*a* of the shaft 8, due to the radially-acting friction of the plates 10*a* against the rotating blades 9.

Figure 19:
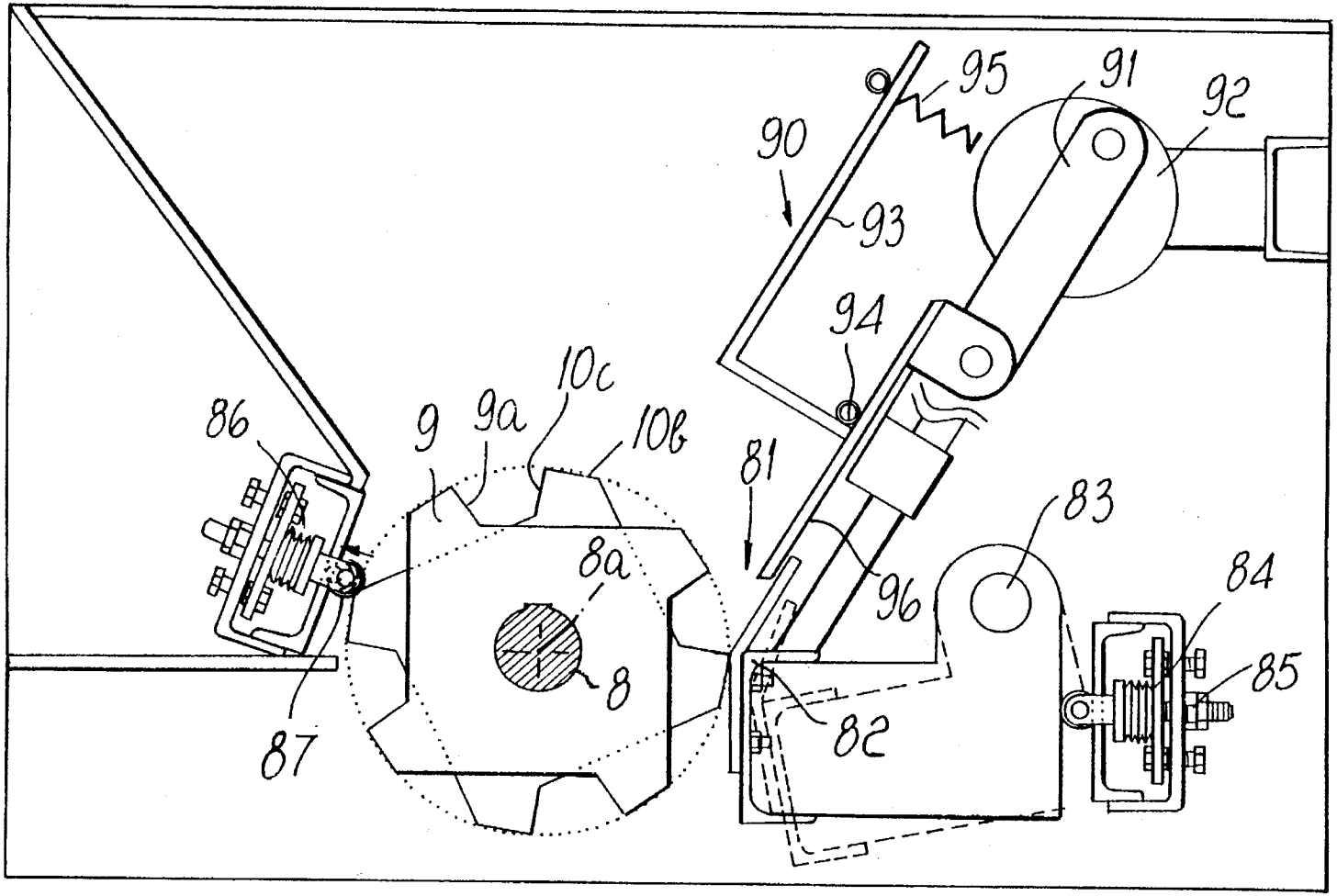
FIG. 19 is a schematic lateral elevation view of a first different embodiment of the shredding apparatus.

As shown in particular in FIG. 19, counter or complementary blades 10*b*, with cutting edges 10*c* that are arranged opposite to the cutting edges 9*a* of the blades 9, can be interposed between said blades 9. The complementary blades 10*b* are freely mounted on the shaft 8 that supports the blades 9. In the embodiment illustrated in FIG. 19, the complementary cutting element, generally designated by the reference numeral 81, is substantially composed of a cutter 82 which lies parallel to the axis 8*a* of the shaft 8 and is laterally adjacent to the cutting element. The cutter 82 is pivoted, by means of one of its portions, about an axis 83 which is substantially parallel to the axis 8*a*. The cutter 82 can thus oscillate about the axis 83 to move away from the axis 8*a* of the shaft 8 in contrast with the action of elastic means such as springs 84 that can be pre-loaded, according to the requirements, by means of a bolt 85. There are also contrast elements, such as springs 86 which, by means of a roller 87, abut against the free complementary blades 10*b* so as to contrast their rotation. If an object that withstands the action of the blades 9 ends between the rotating blades 9*a* and the free blades 10*b*, the blades 10*b* are pushed so that they rotate together with the blades 9. By virtue of this rotation, the blades 10*b* overcome the braking action of the roller 87 and act on the complementary cutting element 81, which is pushed away from the cutting element, in contrast with the springs 84, to allow the non-shreddable object to pass freely.

FIG. 19 also shows a different embodiment of the pressing means, designated in this case by the reference numeral 90, which are actuated by an assembly constituted by a linkage 91 and a crank 92 instead of being actuated by a hydraulic cylinder.

The presser means 90 comprise a plate 93 which is pivoted about an axis 94 to another plate 96 which is associated with the linkage 91. A spring 95 is interposed between the plate 93 and the link 91; if the material forcefully withstands the compression produced by the actuation of the crank 92, said spring 95 compresses and the plate 93 swings to prevent the interruption of the compression action from damaging the crank.

Figure 20:
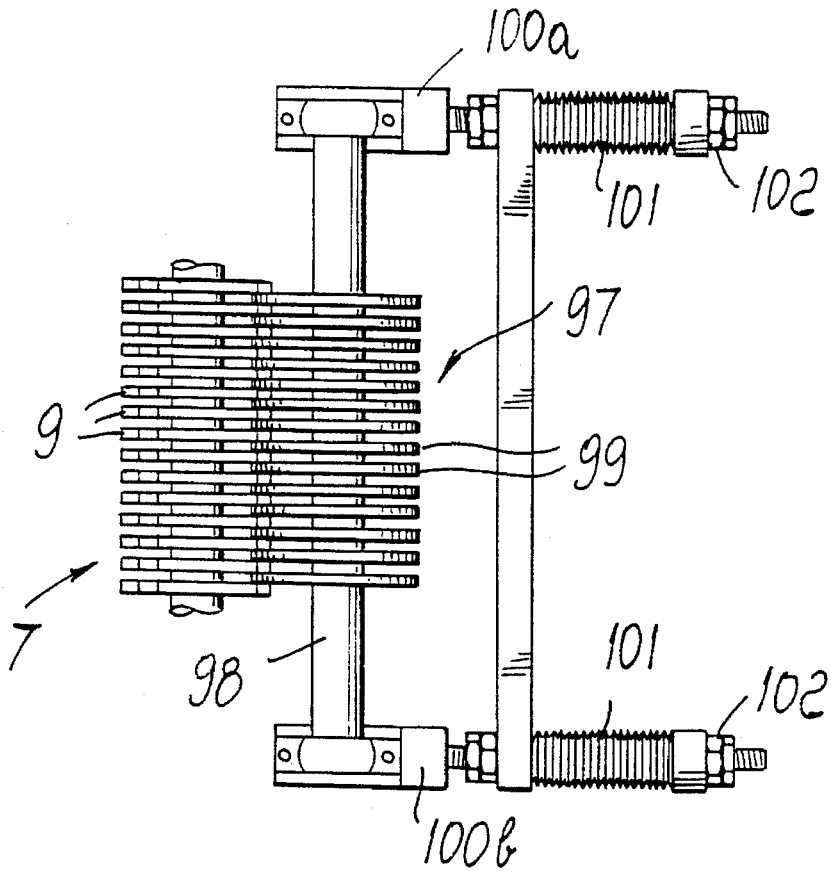
FIG. 20 is a top plan view of a second different embodiment of the shredding apparatus.
Figure 21:
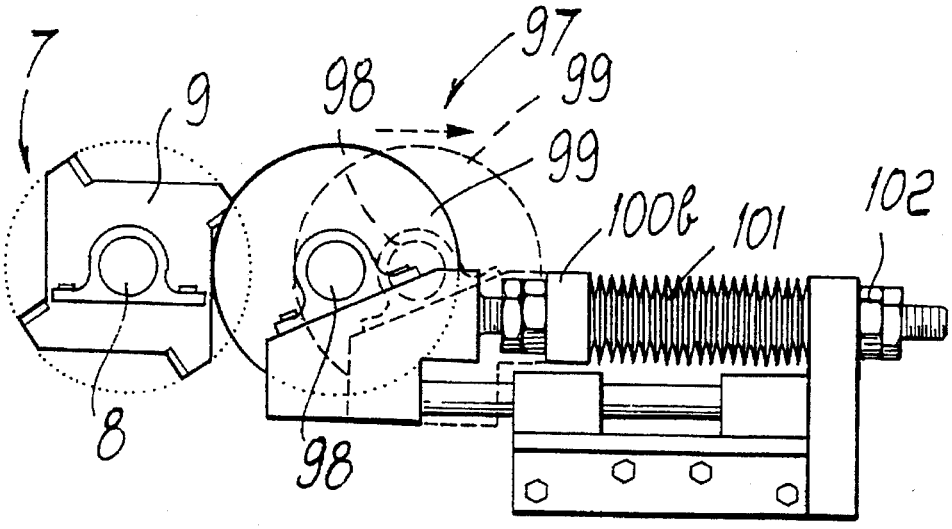
FIG. 21 is a lateral elevation view of the shredding apparatus shown in FIG. 20.

FIG. 20 illustrates a complementary cutting element, generally designated by the reference numeral 97, which is composed of a shaft 98 whose axis is substantially parallel to the axis 8*a* of the shaft 8 of the cutting element 4; said shaft 98 supports multiple blades 99 which are adequately spaced from each other so as to match the spacing of the blades 9, so that they can penetrate between the blades 9.

The shaft 98 can be actuated together with the blades 99 so that it rotates about its axis in the opposite direction with respect to the cutting element, or it can be fixed, according to the requirements.

The shaft 98 is mounted on a slider 100*a* and 100*b* which is slideable along a direction that lies transversely to the axis 8*a* of the cutting element in contrast with the action of springs 101 whose pre-loading can be varied, according to the requirements, by acting on bolts 102.

In practice, in this embodiment, when an object that withstands the action of the blades of the cutting element ends between the cutting element 7 and the complementary cutting element 97, the complementary cutting element 97 is moved away from the cutting element 7, compressing the springs 101, which return the complementary cutting element 97 to the correct position as soon as the non-shreddable object has passed below the cutting element and the complementary cutting element.

In practice it has been observed that the machine according to the invention fully achieves the intended aim, since it is capable of performing, with an extremely limited bulk that does not create problems in terms of environmental impact, and with very low operating power levels, the shredding and compaction of composite material, such as solid urban waste, significantly reducing the costs linked to their transport to collection centers.

The machine thus conceived is susceptible of numerous modifications and variations, all of which are within the scope of the inventive concept; all the details may furthermore be replaced with other technically equivalent elements.

In practice, the materials employed, as well as the dimensions, may be any according to the requirements and the state of the art.

What is claimed is:

1. Machine for triturating composite materials including solid urban waste, which comprises a shredding apparatus that comprises:

a cutting element provided with multiple blades arranged side by side along an axis of the cutting element;

a rotation mechanism for rotating said blades about said axis; and a complementary cutting element which cooperates with said cutting element in shredding material conveyed between said cutting element and said complementary cutting element, said complementary cutting element being movable away from said cutting element to allow material that withstands the action of said blades to pass between said cutting element and said complementary cutting element, said complementary cutting element comprising multiple cutters supported on a supporting element which is movable towards and away from said cutting element;

and wherein the shredding apparatus further comprises a presser device mounted on said supporting element for pressing material loaded in the region that lies between said cutting element and said complementary cutting element.

2. Machine according to claim 1, wherein said cutting element comprises a shart which is arranged so that its axis, which constitutes said axis of the cutting element, is substantially horizontal, said blades being keyed on said shaft, each blade having cutting edges which lie substantially radially with respect to the axis of said shaft.

3. Machine according to claim 2, wherein substantially disk-like spacer plates are interposed between said blades and are keyed coaxially on said shaft.

4. Machine according to claim 2, wherein substantially disk-like mutually coaxial plates are interposed between said blades and are rotatably crossed by said shaft, means being provided for coupling said substantially disk-like plates to the supporting structure of the machine.

5. Machine according to claim 4, wherein said substantially disk-like plates are arranged eccentrically on said shaft.

6. Machine according to claim 2, wherein counterblades are interposed between said blades, have cutting edges arranged opposite to the cutting edges of said blades, and are rotatably crossed by said shaft such that said counterblades are freely rotatably mounted on said shaft, contrast elements being provided for contrasting the rotation of said counterblades.

7. Machine according to claim 1, wherein said complementary cutting element comprises a shaft which is arranged so that its axis is substantially parallel to said axis of the cutting element and has multiple complementary blades keyed thereto, said complementary blades extending between the blades of said cutting element, said shaft of the complementary cutting element being mounted on a slider that is slideable along a transverse direction with respect to said axis of the cutting element.

8. Machine according to claim 7, wherein said shaft of the complementary cutting element can be actuated so as to rotate about its own axis in a direction that is opposite to the direction of the rotation of said blades of the cutting element.

9. Machine according to claim 1, wherein said multiple cutters lie substantially parallel to said axis of the cutting element and are laterally adjacent to the blades of said cutting element.

10. Machine according to claim 1, comprising elastic means which act on said complementary cutting element and contrast the spacing of said complementary cutting element from said cutting element, means being furthermore provided for setting said elastic means.

11. Machine according to claim 1, wherein said supporting element comprises a supporting plate that lies substantially parallel to said axis of the cutting element and supports said multiple cutters that lie between said blades of the cutting element.

12. Machine according to claim 1, wherein a hopper for loading the material to be shredded is arranged above said shredding apparatus.

13. Machine according to claim 12, wherein said hopper has at least one loading port which is closed by a lid that can be opened by control, said lid being openable to such a degree so as to allow only a preset maximum amount of waste to be introduced into said loading port.

14. Machine according to claim 12, wherein said hopper has, proximate to its outlet, a flap for adjusting the flow of material fed to the underlying cutting element.

15. Machine for triturating composite materials including solid urban waste, which comprises a shredding apparatus that comprises:

a cutting element provided with multiple blades arranged side by side along an axis of the cutting element;

a rotation mechanism for rotating said blades about said axis; and a complementary cutting element which cooperates with said cutting element in shredding material conveyed between said cutting element and said complementary cutting element, said complementary cutting element being movable away from said cutting element to allow material that withstands the action of said blades to pass between said cutting element and said complementary cutting element;

wherein said blades are keyed on a shaft and are mutually spaced along the axis of said shaft that constitutes said axis of the cutting element;

counterblades are interposed between said blades, have cutting edges arranged opposite the cutting edges of said blades, and are rotatably crossed by said shaft such that said counterblades are freely rotatably mounted on said shaft;

contrast elements being provided for contrasting the rotation of said counterblades such that the counterblades overcome the action of said contrast elements to rotate together with said blades and abut against said complementary cutting element to move said complementary cutting element away from said cutting element when material that withstands the action of said blades and said counterblades is gripped between said blades and said counterblades.

16. Machine for triturating composite materials including solid urban waste, which comprises a shredding apparatus that comprises:

a cutting element provided with multiple blades arranged side by side along an axis of the cutting element;

a rotation mechanism for rotating said blades about said axis;

a complementary cutting element which cooperates with said cutting element in shredding material conveyed between said cutting element and said complementary cutting element, said complementary cutting element being movable away from said cutting element to allow material that withstands the action of said blades to pass between said cutting element and said complementary cutting element;

a device for moving said complementary cutting element towards or away from said cutting element; and a sensing control device for detecting when said blades of the cutting element have stopped rotating due to a presence of non-shreddable material blocking the rotation of said blades, said sensing control device being operatively connected to said rotation mechanism for stopping said rotating mechanism so as not to rotate said blades in the presence of non-shreddable material, and said sensing control device being operatively connected to said device for moving said complementary cutting element so as to move said complementary cutting element away from said cutting element after said rotation mechanism has been stopped due to the presence of non-shreddable material and for subsequently restarting said rotation mechanism in order to allow the non-shreddable material to pass between said cutting element and said complementary cutting element and for subsequently moving said complementary cutting element back towards said cutting element.

17. Machine according to claim 13, comprising means for detecting when said blades of the cutting element have stopped rotating including means for sensing the tension of a drive element of said rotation mechanism.

18. Machine according to claim 16, wherein said complementary cutting element is pivoted to the supporting structure of the machine about an axis which is substantially parallel to the axis of the cutting element, said device for moving said complementary cutting element comprising a hydraulic cylinder which acts on said complementary cutting element to make it swing towards or away from a shaft of said cutting element.

19. Machine according to claim 16, wherein said complementary cutting element comprises multiple cutters which are mutually spaced so as to match the spacing of said multiple blades of said cutting element.

20. Machine according to claim 16, comprising means for conveying the material that leaves said shredding apparatus to a compaction apparatus.

21. Machine according to claim 20, wherein said conveyance means comprise a conveyor that lies in a ring-like arrangement around a substantially horizontal axis, said conveyor having an inlet in a lower region of its extension and an outlet in an upper region in order to raise the material that leaves said shredding apparatus and transfer it to said compaction apparatus.

22. Machine according to claim 21, wherein said ring-like conveyor has a substantially horizontal axis that lies transversely to the axis of the cutting element, said ring-like conveyor comprising: a ring-shaped closed channel extending about said horizontal axis; a lower opening in said channel for receiving material into the channel from the shredding apparatus and an upper opening in said channel for expulsion of material from said channel to said compaction apparatus; and paddle elements rotatably movable about said horizontal axis in said channel for moving material in said channel from said lower opening to said upper opening.

23. Machine according to claim 21, wherein at the outlet of said conveyor of the conveyance means there is a device for expelling the material to convey it to said compaction apparatus.

24. Machine according to claim 21, wherein said compaction apparatus comprises a container which is suitable to receive the material that leaves said shredding apparatus and a presser element arranged above said container, the machine further comprising sensor means for detecting the position of the presser element and the presence of the container.

25. Machine according to claim 24, comprising means for moving said complementary cutting element towards or away from said cutting element and a presser device mounted on said complementary cutting element for pressing material loaded in the region that lies between said cutting element and said complementary cutting element, an electronic control and actuation element connected to said sensor means being provided which actuates said cutting element, said means for moving said complementary cutting element, said presser device, and said compaction apparatus.

26. Machine according to claim 24, wherein said presser element is constituted by a pantograph press.

27. Machine according to claim 20, wherein said shredding apparatus and said compaction apparatus are arranged inside a box-like structure, said compaction apparatus comprising a wheeled container and lateral hooks which are pivoted to said wheeled container for engagement by lifting units of a truck to unload material from the container into the truck.

28. Machine for triturating composite materials including solid urban waste, which comprises a shredding apparatus that comprises:

a cutting element provided with multiple blades arranged side by side along an axis of the cutting element;

a rotation mechanism for rotating said blades about said axis;

a complementary cutting element which cooperates with said cutting element in shredding material conveyed between said cutting element and said complementary cutting element;

the machine further comprising:

a compaction apparatus with a container, the compaction apparatus being adapted for receiving material from said shredding apparatus;

a presser device arranged above the container for pressing material in the container; and a leveling device for leveling the material in said container, said leveling device being supported on a lower portion of the presser device, and said leveling device being slidably movable by an activation device of said presser device for leveling material inside said container.

* * * * *

UNITED STATES PATENT AND TRADEMARK OFFICE

CERTIFICATE OF CORRECTION

PATENT NO. : 5,595,348

DATED : January 21, 1997

INVENTOR(S) : Giuseppe Barone

It is certified that error appears in the above-identified patent and that said Letters Patent are hereby corrected as shown below:

Column 9, line 34, "shart" should be --shaft--.

Signed and Sealed this

Second Day of December,1997

*Attest:*

Bruce Lehman

BRUCE LEHMAN

*Attesting Officer*

*Commissioner of Patents and Trademarks*